US012180638B2

(12) United States Patent
Minai et al.

(10) Patent No.: US 12,180,638 B2
(45) Date of Patent: Dec. 31, 2024

(54) DRUM WASHING MACHINE AND FIXING DEVICE FOR DRUM WASHING MACHINE

(71) Applicant: SAMSUNG ELECTRONICS CO., LTD., Suwon-si (KR)

(72) Inventors: Hitoshi Minai, Yokohama (JP); Takehiro Nakanishi, Yokohama (JP); Minsu Kim, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 308 days.

(21) Appl. No.: 17/692,431

(22) Filed: Mar. 11, 2022

(65) Prior Publication Data

US 2022/0220655 A1 Jul. 14, 2022

Related U.S. Application Data

(63) Continuation of application No. PCT/KR2021/016278, filed on Nov. 9, 2021.

(30) Foreign Application Priority Data

Jan. 8, 2021 (JP) ..... 2021-002299
Aug. 31, 2021 (KR) ..... 10-2021-0115761

(51) Int. Cl.
*D06F 37/04* (2006.01)
*D06F 37/06* (2006.01)
*D06F 37/40* (2006.01)

(52) U.S. Cl.
CPC ..... *D06F 37/04* (2013.01); *D06F 37/06* (2013.01); *D06F 37/40* (2013.01)

(58) Field of Classification Search
USPC ..... 68/12.24, 23.6, 131, 133, 142
See application file for complete search history.

(56) References Cited

U.S. PATENT DOCUMENTS

2003/0084585 A1 5/2003 Tomasi et al.

FOREIGN PATENT DOCUMENTS

| | | |
|---|---|---|
| JP | 11-276768 | 10/1999 |
| JP | 2004-97317 | 4/2004 |
| JP | 2008-136824 | 6/2008 |
| JP | 2011-257059 | 12/2011 |
| JP | 2012-139443 | 7/2012 |

(Continued)

OTHER PUBLICATIONS

Kato, "JPH11276768A English Machine Translation.pdf", Oct. 12, 1999—Machine translation from Espacenet.com.*

(Continued)

*Primary Examiner* — Levon J Shahinian
(74) *Attorney, Agent, or Firm* — STAAS & HALSEY LLP

(57) ABSTRACT

A drum washing machine capable of washing a helmet includes a pulsator installed on a bottom of a drum and configured to be rotatable independently of the drum. A fixing device is configured to detachably fix an object to be washed having a three-dimensional shape to an inner lower side of the drum. A processor is configured to control a water storage process for storing water in the tub in an amount, in which at least a part of the pulsator is submerged, and to control a pulsator to agitate the water inside the tub by rotating the pulsator in a state in which the drum is stopped to maintain a lower position of the object to be washed.

15 Claims, 11 Drawing Sheets

(56) References Cited

FOREIGN PATENT DOCUMENTS

| | | |
|---|---|---|
| JP | 2012-523937 | 10/2012 |
| JP | 2014-146531 | 8/2014 |
| JP | 2016-49265 | 4/2016 |
| JP | 2018-20215 | 2/2018 |
| JP | 2018-86232 | 6/2018 |
| JP | 2019-84328 | 6/2019 |
| JP | 2020-110369 | 7/2020 |
| KR | 10-0449013 | 9/2004 |
| KR | 10-0802063 | 2/2008 |
| KR | 10-2012-0031293 | 4/2012 |
| KR | 10-1222569 | 1/2013 |
| KR | 10-2019-0039018 | 4/2019 |

OTHER PUBLICATIONS

International Search Report dated Mar. 4, 2022 in International Patent Application No. PCT/KR2021/016278.

* cited by examiner (d)

(e)

(f)

DRUM WASHING MACHINE AND FIXING DEVICE FOR DRUM WASHING MACHINE

CROSS-REFERENCE TO RELATED APPLICATION

This application is a continuation application, which claims the benefit under 35 U.S.C. § 111(a) of PCT Application PCT/KR2021/016278 filed Nov. 9, 2021 which claim the benefit of Japanese Patent Application No. 2021-002299 filed on Jan. 8, 2021 and Korean Patent Application No. 10-2021-0115761 filed on Aug. 31, 2021. The contents of PCT Application No. PCT/KR2021/016278 filed Nov. 9, 2021 and Japanese Patent Application No. 2021-002299 filed on Jan. 8, 2021 and Korean Patent Application No. 10-2021-0115761 filed on Aug. 31, 2021 are incorporated by reference herein in their entirety.

FIELD

The present disclosure relates to a washing technique for a drum washing machine.

BACKGROUND

A drum washing machine is a washing device for generally washing flexible clothes, but various studies have been proposed so far to wash three-dimensional articles or things other than clothes.

For example, Patent Document 1 discloses a drum washing machine in which a partition plate is radially arranged inside a drum and the inside of the drum is divided into a plurality of small spaces to wash shoes. Patent Document 2 discloses a drum washing machine in which a pair of shoes are pressed and fixed on both sides of an inner circumferential surface of a drum with a rod-shaped mechanism so as to wash the shoes.

Regarding the disclosed technology, although it is not a washing machine, Patent Document 3 discloses an ion generator that sterilizes and deodorizes a helmet.

In addition, with respect to the disclosed technology, the present applicant has proposed a powerful drum washing machine capable of obtaining a washing effect superior to that of the conventional drum washing machine (Patent Document 4). In addition to the drum being rotatable in both forward and reverse directions, the drum washing machine includes a pulsator rotatable in both forward and reverse directions independently of the drum. Therefore, in a washing or rinsing process, both the drum and the pulsator are rotated independently of each other so as to increase the movement of the clothes.

PATENT LITERATURE

[Patent Document 1] Japanese Patent Laid-Open No. 2004-97317

[Patent Document 2] US 2003084585 A1

[Patent Document 3] Japanese Patent Laid-Open No. 2011-257059

[Patent Document 4] Japanese Patent Laid-Open No. 2020-110369

SUMMARY

When playing contact sports, such as American football, ice hockey, and lacrosse, players wear various protective equipment, such as helmets and protective gear. Because the protective equipment adheres to the player's body, a large amount of sweat, sebum, and dust attaches to the protective equipment after the play.

If the contaminated protective equipment is left unattended, it will not only become dirty, but also cause a bad odor. Therefore, there is a demand for such protective equipment to be washed as often as possible, like clothes.

Accordingly, protective equipment is relatively flexible in many cases and is divided into a plurality of members. Therefore, it is possible to wash most protective equipment using a washing machine. Therefore, it is possible to wash the protective gear relatively frequently, and thus the protective gear may be used in a clean state.

On the other hand, the helmet is formed in that a strong plastic material is wrapped around in a hat shape. Further, it is large in size and heavy, and thus it is not easy to wash the helmet.

When cleaning the helmet, a user has no choice but to wash the helmet after soaking the helmet or ask a professional company to do it. However, this is laborious and costly. Therefore, in general, the helmet is not washed after use, but is sprayed with a deodorizing spray or wiped off contamination.

It is difficult to wash helmets with a washing machine. Particularly, in the case of a drum washing machine, a wet object is lifted and dropped by the rotation of the drum, and the object is washed by using the impact (it is referred to as "beating washing").

Therefore, objects that are washed with a drum washing machine are originally limited to flexible clothes and the like. In addition to helmets, when hard objects or heavy objects are washed with a drum washing machine, the drum and helmet are damaged by the impact of the drop.

The present disclosure is directed to providing a drum washing machine including a pulsator configured to be rotatable independently of a drum. According to the present disclosure, by utilizing a function of such a drum washing machine, it may be possible to wash things that may not be washed in the conventional washing machine.

That is, it may be possible to implement unexpected washing using a specific drum washing machine.

The disclosed technology is related to a drum washing machine.

One aspect of the disclosure provides a drum washing machine including a housing including an inlet formed on a front surface, a tub installed inside the housing to store water, a drum rotatably accommodated in the tub in a state in which an opening faces the inlet, a water supply device configured to supply water to the tub, a drainage device configured to discharge the water from the tub, a pulsator installed on a bottom of the drum and configured to be rotatable independently of the drum, a controller configured to control an operation of the water supply device and the drainage device and configured to control a rotation of the drum and the pulsator, and a fixing device configured to detachably fix an object to be washed having a three-dimensional shape to an inner lower side of the drum.

The controller may include a special washing processor configured to perform a washing operation of the object to be washed, and the special washing processor may be configured to perform a water storage operation for storing water in the tub in an amount, in which at least a part of the pulsator is submerged, and configured to perform a agitating operation for agitating the water inside the tub by rotating the pulsator in a state in which the drum is stopped to maintain a position of the object to be washed that is placed in the lower side.

That is, the drum washing machine may include the pulsator installed on the bottom of the drum and configured to be rotatable independently of the drum unlike a general drum washing machine. Therefore, the object to be washed having a three-dimensional shape that cannot be washed in the conventional drum washing machine may be detachably fixed to the inner lower side of the drum with the fixing device.

The special washing processor of the controller may store water in the tub in an amount, in which at least a part of the pulsator is submerged, by driving the water supply device, and perform the operation for agitating the water inside the tub by rotating the pulsator in a state of regulating a rotation of the drum to maintain the lower position of the object to be washed.

Accordingly, the pulsator may be rotated and thus the water stored in the drum may be agitated. Due to the small amount of water, the torque may be small and thus the pulsator may be rotated rapidly in a stopped state. Therefore, water may be agitated effectively. A lower portion of the object to be washed that is submerged may be washed by the flow of water. At the same time, the water stored in the drum may be raised high by the rotation of the pulsator and the water may be scattered upward of the object to be washed. An upper part of the object to be washed may be also washed by the scattered water.

Therefore, with the small amount of water, it is possible to effectively wash the object to be washed, which cannot be originally washed, using a specific drum type washing machine.

The drum washing machine may further include a drum stopper arranged between the tub and the drum and provided to mechanically couple the drum to the tub, and the rotation of the drum may be regulated by the drum stopper.

Accordingly, it is possible to stably regulate the rotation of the drum.

The drum washing machine may further include a motor configured to rotate the drum, and the rotation of the drum may be regulated by electrically controlling the motor.

In this case, the rotation of the drum may be regulated. Because it is electrically controlled, there is an advantage in that a mechanical mechanism is not required.

In the drum washing machine, in the water storage operation, water may be stored in the tub until a water surface is located below a center of the pulsator.

It is possible to effectively agitate the stored water as well as raising water high upward by the rotation of the pulsator, and thus it is possible to spray water from the upper side of the object to be washed. Further, it is possible to save water.

In the drum washing machine, the special washing processor may rotate the pulsator in both a forward rotation direction and a reverse rotation direction in the agitating operation.

By reversing the rotation direction of the pulsator, it is possible to improve an agitating action and a sprinkling action. Because the deflection of the flow of water and the sprinkling water are suppressed, the object to be washed may be washed in a balanced manner.

The drum washing machine may further include a water circulation mechanism configured to circulate the water stored in the tub by spraying the water into the drum, and the water circulation mechanism may be driven in response to the washing operation of the object to be washed by the special washing processor.

Because the water is sprayed to the inside of the drum, the upper part of the object to be washed may be further washed. Because the fluidity of the water stored in the tub and the drum is also increased, the lower part of the object to be washed may be further washed.

In the drum washing machine, the fixing device may include a holder mountable on an inner circumferential surface of the drum, and provided to support the object to be washed, and the object to be washed may be fixed to the lower inside of the drum through the holder.

Accordingly, it is possible to simply and stably fix the object to be washed to the inner lower side of the drum.

Particularly, it is suitable when the object to be washed is a helmet.

For example, the helmet may include a through hole formed on opposite sides of the helmet, and the holder may support the helmet through the through hole.

Particularly, the holder may include a first coupling member mountable to the inner circumferential surface of the drum, a second coupling member connectable to the first coupling member through a shaft portion, and the helmet may be supported by the holder by connecting the first coupling member to the second coupling member in a state in which the shaft portion is inserted into the through hole.

More particularly, the first coupling member may include a body connected to the second coupling member, a mounting plate elastically deformable and protruding from an outer edge portion of the body, and a magnet provided along an edge of the mounting plate. As the mounting plate is pressed against the inner circumferential surface of the drum by a magnetic force of the magnet, the holder may be fixed to the inner circumferential surface of the drum.

Accordingly, it is possible to simply and stably fix the helmet to the inner lower side of the drum.

The disclosed technology also relates to a washing method using a drum washing machine including a pulsator rotatable independently of the drum.

Another aspect of the present disclosure provides a washing method including a first step of removably fixing an object to be washed to an inner lower side of a drum through a fixing device; a second step of storing water to a tub in an amount, in which at least a part of a pulsator is submerged, and a third step of agitating the water inside the tub by rotating the pulsator in a state in which a rotation of the drum is regulated to maintain a position of the object to be washed that is placed in the lower side.

As described in the above-described drum washing machine, according to the washing method, it is possible to effectively wash the object to be washed, which cannot be originally washed, using a specific drum type washing machine with the small amount of water.

In the second step, water may be stored in the tub until a water surface is located below a center of the pulsator. In the third step, the pulsator may be rotated in both a forward rotation direction and a reverse rotation direction. In the third step, the water stored in the tub may be circulated by being sprayed into the drum. The same effect as the description of the above-described drum washing machine may be obtained. In addition, a fact that the object to be washed is a helmet may be the same as the description of the above-described drum washing machine.

DETAILED DESCRIPTION

Figure 1A:
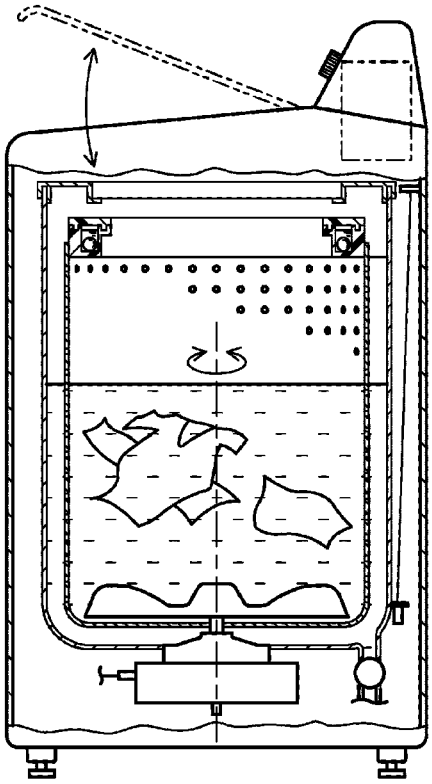
FIG. 1A is a view illustrating laundry washing by a vertical washing machine.

It is possible to wash things that is normally not conceivable, such as a helmet, by using a specific drum washing machine.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front side", "rear side", "left side", "right side", and the like may be defined by the drawings, but the shape and the location of the component is not limited by the term.

The disclosure will be described more fully hereinafter with reference to the accompanying drawings. The following description is merely exemplary in nature and is in no way intended to limit the present disclosure or its application or uses.

<Type of Washing Machine>

Figure 1B:
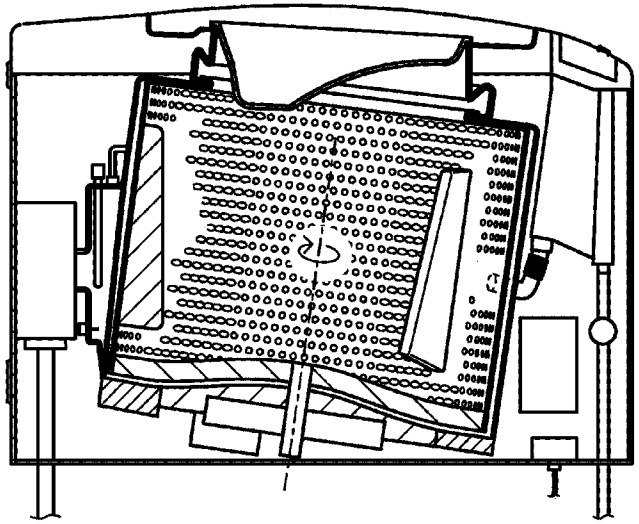
FIG. 1B is a view illustrating laundry washing by a drum washing machine.

Home washing machines are broadly classified into vertical washing machines and drum washing machines. FIGS. 1A and 1B illustrate such washing machines.

As shown in FIG. 1A, in general, a vertical washing machine puts clothes and a sufficient amount of washing water into a drum arranged in a water tub that is vertically placed, and washes the clothes with the water flow generated by agitating the stored washing water with a pulsator (agitating blade), (it is referred to as "rubbing washing").

On the other hand, as shown in FIG. 1B, in a drum washing machine, a drum is placed horizontally in a water tub. The drum is loaded with clothes and a small amount of washing water, and the drum is rotated to lift and then drop the clothes to mechanically wash the clothes (it is referred to as "beating washing"). Particularly, the drum washing machine may perform the washing with a smaller amount of water. Therefore, the drum washing machine has an advantage of saving water compared to the vertical washing machine.

However, in the case of a drum washing machine, because a strength of a mechanical action of beating-washing is largely determined by the fall of clothes according to the size of the drum, it is difficult to strengthen the washing power. It is conceivable to increase the number of rotations of the drum to increase the frequency of dropping, but even in this case, there is a limit because the clothes stick to the drum and do not fall if the rotation number is increased.

Accordingly, what the present applicant has proposed is a drum washing machine including a pulsator configured to be rotatable independently of the drum (hereinafter also referred to as "high-performance washing machine"; refer to Patent Document 4). The high-performance washing machine may provide an action of rubbing clothes with each other due to the movement of the clothes, as well as the mechanical action, such as "beating washing" obtained by the conventional drum washing machine. Therefore, the high-performance washing machine has superior washing power compared to the conventional drum washing machine.

The disclosed technology is an application of the high-performance washing machine. Therefore, the drum washing machine disclosed in one embodiment is based on the high-performance washing machine.

<Drum Washing Machine>

Figure 2:
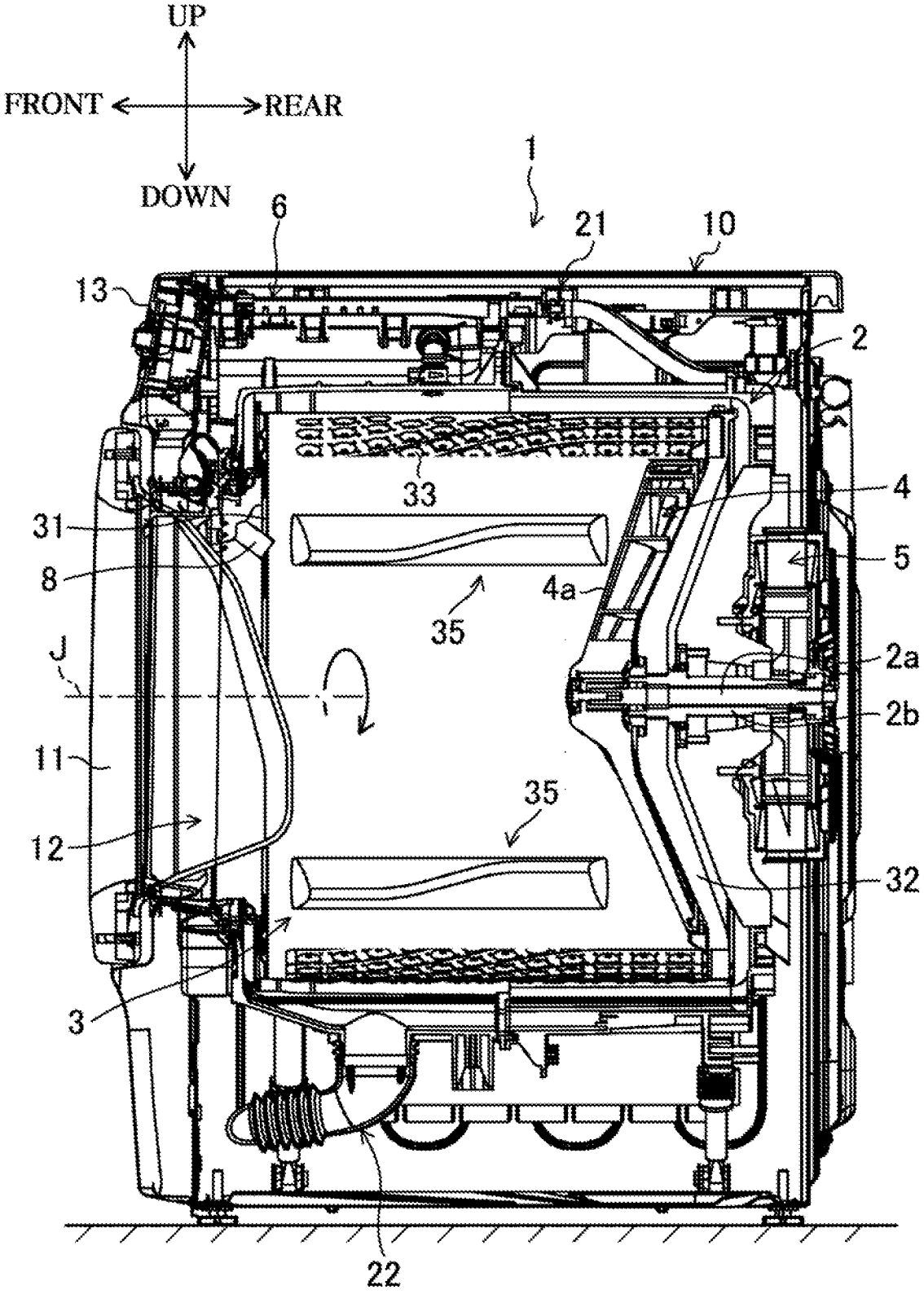
FIG. 2 is a cross-sectional view schematically illustrating a structure of a drum washing machine according to one embodiment of the present disclosure.

FIG. 2 illustrates a structure of the drum washing machine according to the present embodiment (hereinafter also referred to as a washing machine 1). The washing machine 1 includes a housing 10, a tub 2, a drum 3, a pulsator 4, a motor 5, a processor 6 (controller), and the like. In addition, the washing machine 1 also includes a fixing device for washing a specific object to be washed different from clothes (the specific object to be washed and the fixing device will be described later).

In addition, the washing machine 1 is configured such that each of washing process, rinsing process, and spin-drying process are performed automatically according to a set program (fully automatic). The washing machine 1 of the present embodiment does not have a drying function. Accordingly, although the drying process is not performed, a drying device may be provided in the washing machine 1 to automatically perform the drying process.

The housing 10 is composed of a frame or a panel, and is formed in a box shape. A circular inlet 12 provided to be opened and closed by a door 11 is formed in a substantially center of a front surface of the housing 10. Clothes enters and exits through the inlet 1. A specific object to be washed also enters and exits through the inlet 12. A control panel 13, in which a monitor, a switch, and the like is arranged, is installed on a front upper portion of the housing 10. The processor 6 is built in the rear of the control panel 13.

The tub 2 is formed of a cylindrical container with a bottom provided to store water. The tub 2 is installed inside the housing 10 in a state in which an opening of the tub 2 is horizontally arranged toward the inlet 12. In the washing process or the rinsing process, washing water or rinsing water is stored in a lower portion of the tub 2.

A water supply device 21 configured to supply water to the tub 2 from an external water supply source through a pipe is installed above the tub 2. Although not shown, a detergent tray is installed in the water supply device 21 to accommodate detergent and the like and send the detergent and the like to the tub 2 together with water when water is supplied. In addition, a drainage device 22 configured to discharge unnecessary water from the tub 2 is provided below the tub 2.

In addition, the washing machine 1 is also provided with a water circulation mechanism configured to circulate the water stored in the tub 2 by spraying the water into the drum 3. The water circulation mechanism may be composed of a circulation path including a circulation pump, a pipe and a hose, and a spray nozzle 8. The spray nozzle 8 is installed above the opening of the tub 2 in a state in which a discharge port faces the inside of the drum 3, as illustrated in FIG. 2.

A lower end of the circulation path is connected to a bottom of the tub 2, and an upper end of the circulation path is connected to the spray nozzle 8. The circulation pump is installed on the lower side of the circulation path. The circulation pump sends the water stored in the tub 2 toward the spray nozzle 8 through the circulation path under the control of the processor 6. Because a structure of the water circulation mechanism is well-known, illustration except for the spray nozzle 8 will be omitted.

The drum 3 is composed of a cylindrical container including an opening 31 at one end and a bottom 32 at the other end. The drum 3 is mainly formed of a stainless-steel sheet. The drum 3 is accommodated in the tub 2 in such a way that the opening 31 faces the inlet 12 and the bottom 32 faces the rear side. The drum 3 is rotatable about a rotation axis J extending in a front and rear direction (the rotation axis J is approximately horizontal or inclined upward toward the front).

A plurality of through holes 33 penetrating the inside and outside is formed on a circumferential surface of the drum 3. A plurality of lifters 35 is provided inside the drum 3. Each lifter 35 is formed of a substantially columnar member having a substantially triangular cross-section. The lifter 35 protrudes inward from an inner circumferential surface of the drum 3 and extends in a direction parallel to the rotation axis J (rotation axis direction). Each lifter 35 is arranged at substantially constant intervals in the circumferential direction.

One pulsator 4 is installed at the bottom 32 of the drum 3. The pulsator 4 is formed of a disk-shaped member having an approximately conical shape with a low vertex. A diameter of the pulsator 4 is formed slightly less than a diameter of the bottom 32 of the drum 3. A surface of the pulsator 4 is provided with a plurality of protrusions 4*a* (three according to the embodiment) protruding and extending in a radial direction.

An inner shaft 2*a* and an outer shaft 2*b* that are rotated independently of each other are installed at the bottom 32 of the tub 2 (dual shaft structure). The drum 3 is connected to an upper end of the outer shaft 2*b*. The pulsator 4 is connected to an upper end of the inner shaft 2*a* passing through the bottom 32 of the drum 3.

Accordingly, the pulsator 4 and the drum 3 are rotated independently of each other about the rotation axis J. In addition, the outer shaft 2*b* and the inner shaft 2*a* are connected to the motor 5 arranged at the rear of the tub 2.

(Motor 5)

The motor 5 may include a single stator, an inner rotor and an outer rotor arranged an inside and outside thereof. The inner rotor and the outer rotor are provided with permanent magnets forming a different number of magnetic poles, respectively. The outer shaft 2*b* is connected to the inner rotor. The inner shaft 2*a* is connected to the outer rotor.

The stator is shared by both the outer and inner rotors. That is, a compound current, in which the current corresponding to the number of magnetic poles of each rotor is superimposed, is supplied to the stator through inverter control. Accordingly, the two rotors are configured to be rotatable independently of each other. The motor 5 rotates the drum 3 and the pulsator 4 in a predetermined direction of forward rotation or reverse rotation, respectively, at a predetermined speed through the outer shaft 2*b* and the inner shaft 2*a* (dual rotor motor).

Such a motor is an example. As long as the drum 3 and the pulsator 4 are driven independently of each other, a driving mechanism may be selected according to the specifications. For example, the drum 3 and the pulsator 4 may be driven individually by two motors, respectively, or the drum 3 and the pulsator 4 may be driven by a single motor in which two rotors and two stators corresponding to the drum 3 and the pulsator 4 are integrally configured.

(Processor 6)

Figure 3:
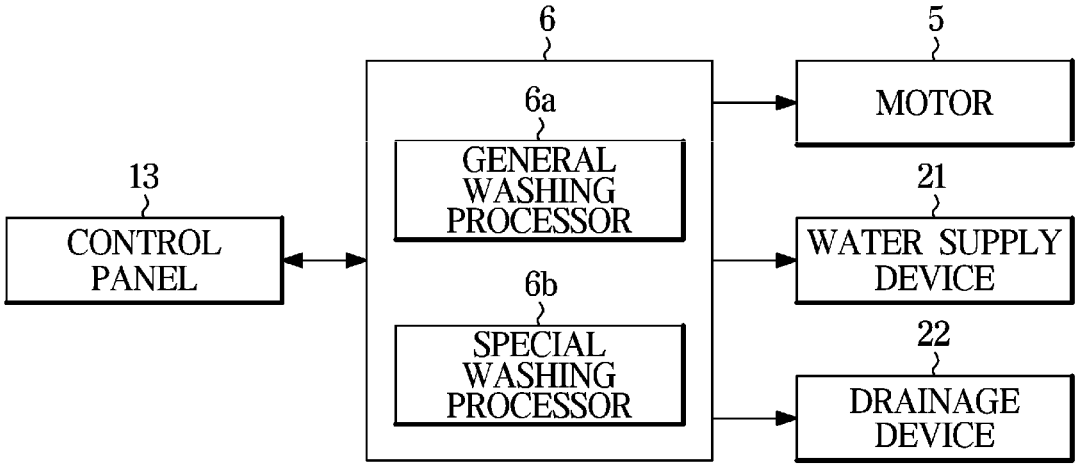
FIG. 3 is a block diagram illustrating a relationship between a processor and a main related device.

FIG. 3 illustrates a relationship between the processor 6 and the main related devices. The processor 6 is composed of hardware such as a CPU, a memory, and an interface, and software such as a control program and data mounted on the hardware. The processor 6 is electrically connected to the control panel 13, the motor 5, the water supply device 21, the drainage device 22, and the like.

Based on a signal input from the control panel 13, the processor 6 outputs a control signal to the motor 5 or the like and comprehensively controls the washing machine 1. The processor 6 is provided with a general washing processor 6*a* and a special washing processor 6*b* for controlling the washing machine 1 as a functional configuration. The general washing processor 6*a* may be a general washing portion 6*a* or a general washing unit 6*a*, and the special washing processor 6*b* may be a special washing portion 6*b* or a special washing unit 6*b*.

The general washing processor 6*a* performs an original washing operation of the washing machine for clothes. That is, the general washing processor 6*a* automatically performs a series of processes including a washing process, a rinsing process, and a spin-drying process.

For example, the general washing processor 6*a* supplies a predetermined amount of washing water or rinsing water to the tub 2 by operating the water supply device 21 in the washing process and the rinsing process. The general washing processor 6*a* controls the motor 5 to rotate the pulsator 4 and the drum 3 in the same direction or in the counter direction while switching at a predetermined timing.

The general washing processor 6*a* operates the drainage device 22 to discharge the water stored in tub 2. In the spin-drying process, the general washing processor 6*a* controls the motor 5 to synchronize and rotate the pulsator 4 and the drum 3 in the same direction while operating the drainage device 22 to discharge the water from the tub 2. Accordingly, it is possible to spin-dry the clothes by using the centrifugal force.

On the other hand, by a special washing method using a fixing device, the special washing processor 6*b* performs a washing operation (special washing operation) of a specific object to be washed different from clothes. The special washing operation will be described later in detail.

<Object to be Washed with Special Washing Operation>

A specific example of the object to be washed in the special washing operation includes a helmet worn in contact sports, such as American football, ice hockey, and lacrosse. A specific example of the object may include a helmet worn in cycling sports, such as cycling or mountain biking.

The specific example of the object is not limited to a helmet, and the specific example of the object may include other sports gear worn in sports, such as ski boots and goggles. Further, the object may include safety gear worn in work involving physical labor, such as construction work, machining work, agriculture, etc. In addition, the object is not limited to the sports gear and the safety gear, and may include various mechanisms. That is, as long as a thing that is washable with water and has a three-dimensional shape that can be accommodated in the drum 3, the thing may correspond to the object to be washed.

<Fixing Device>

The fixing device is used to detachably fix the object, which is to be washed, accommodated in the drum 3, to the drum 3. The fixing device may prevent the object to be washed from moving inside the drum 3 even when the force of the water flow is applied during the washing operation. However, because it is required for the fixing device to enter and exit through the inlet 12, it is appropriate that a user can easily handle the fixing device. Further, it is appropriate that the fixing device is used for various objects to be washed.

(Universal Fixing Device)

Figure 4:
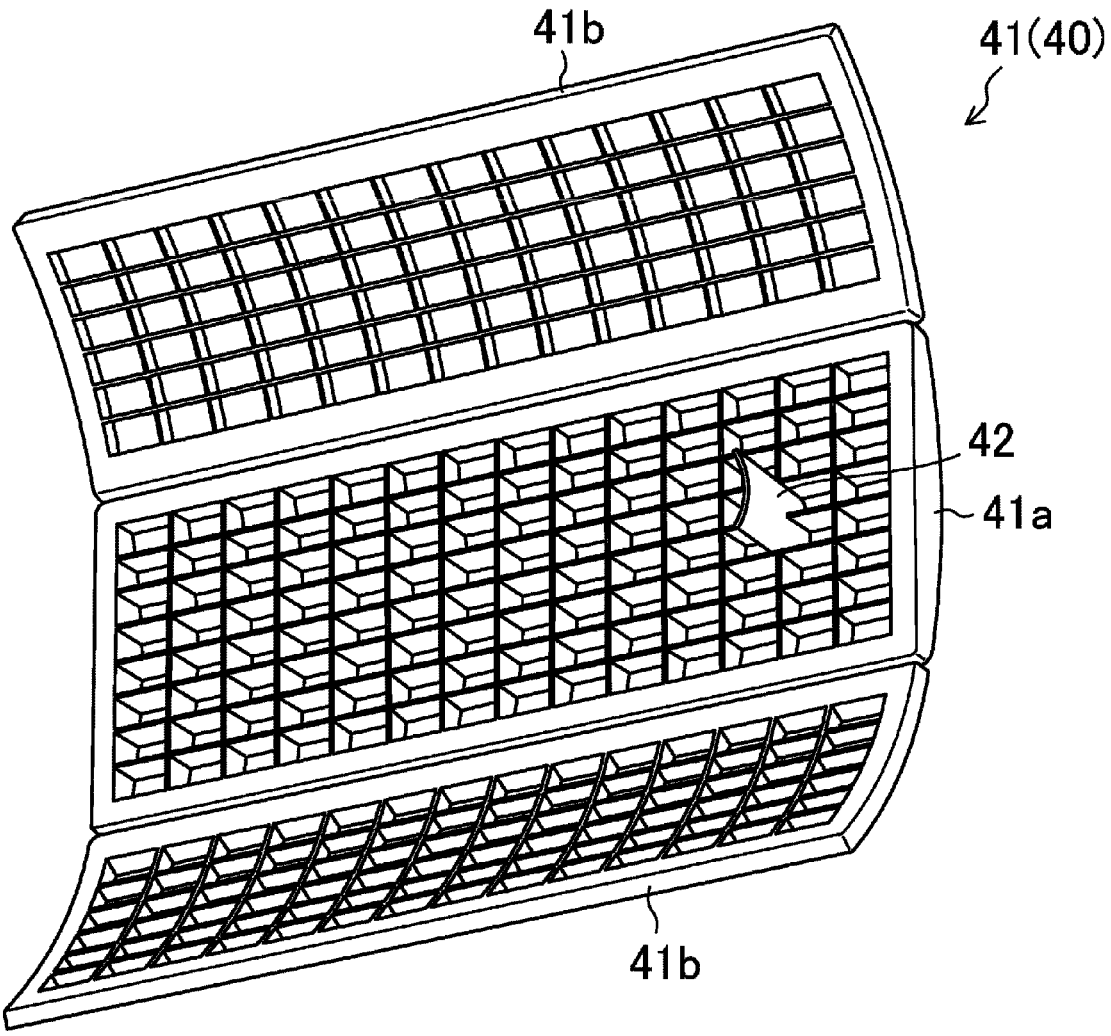
FIG. 4 is a perspective view schematically illustrating an example of a universal fixing device.

FIG. 4 illustrates an example of the fixing device. The fixing device 40 includes a holder 41 formed of a plastic material and formed to have a cross section in an arc shape according to a shape of the inner circumferential surface of the drum 3. The holder 41 is provided in such a way that a plurality of grid plates 41*a* and 41*b* (three grid plates on the drawings) is connected rotatably in the circumferential direction so as to be foldable.

Each plate 41*a*, and 41*b* is formed in a grid shape by installing a rib between rectangular frames. The holder 41 includes a single center plate 41*a* and two side plates 41*b* and 41*b* connected to opposite sides of the center plate 41*a*. At a predetermined position on an inner surface of the center plate 41*a*, a display projection 42 defining an interference position with the pulsator 4 is provided.

A width of each plate 41*a*, and 41*b* is set to be approximately the same size, and by folding the two side plates 41*b* and 41*b* toward the center plate 41*a* side, the width of the plate may be reduced to approximately ⅓. A length of each plate 41*a*, and 41*b* is approximately equal to a length of the inner circumferential surface of the drum 3 in the front and rear direction, and the holder 41 is designed to be fitted in the front and rear direction inside the drum 3 so as to prevent the distortion.

The holder 41 is also designed to be accommodated between two lifters 35 and 35 adjacent to each other in a state in which the holder 41 is unfolded along the inner circumferential surface of the drum 3. The holder 41 may be designed to be fitted between the two lifters 35 and 35 in response to being accommodated in the drum 3. In addition, a magnet may be provided on a rear surface of the holder 41 to allow the holder 41 to be suctioned to the inner surface of the drum 3 by a magnetic force.

The holder 41 may enter and exit from the inlet 12 in a folded state. Therefore, it is easy to handle the holder 41. The holder 41 is unfolded inside the drum 3 so as to be mounted on the inner circumferential surface of the drum 3. In this case, by arranging the holder 41 to place the protrusion 42 to the inside of the drum 3, a position interfering with the pulsator 4 may be easily recognized The fixing device may further include a restraining tool (not shown) configured to install the object to be washed to the holder 41. By installing the object to be washed to the holder 41 with a restraining tool, the object to be washed may be fixed to the lower portion of the drum 3 through the holder 41.

It is appropriate that the restraining tool includes a rope or a net including a hook provided at a tip and adjustable in length. With the restraining tool, the object to be washed may be easily tied by hooking a hook to the grid rib of the holder 41.

(Fixing Device for Helmet)

Figure 5:
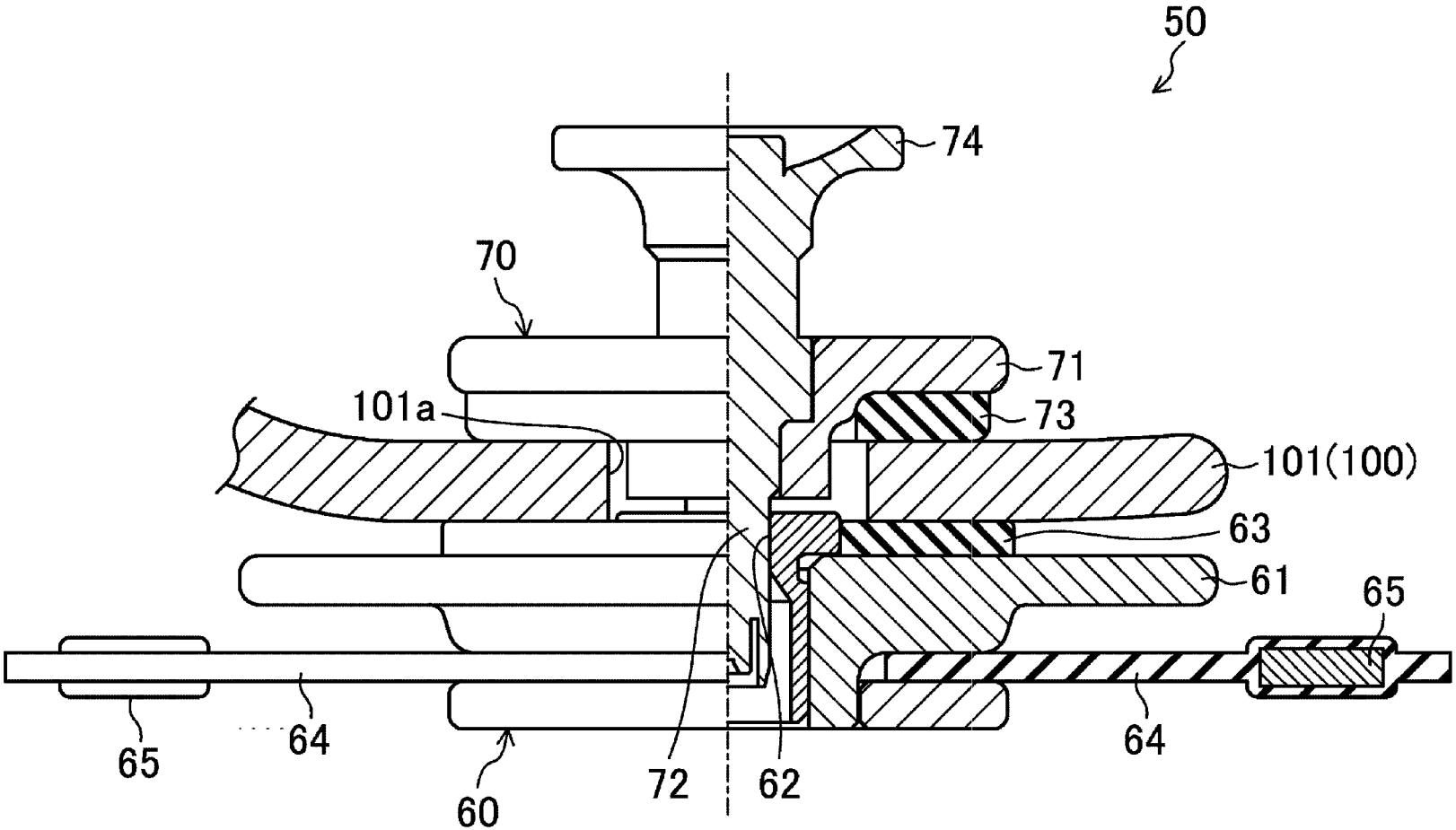
FIG. 5 is a schematic view illustrating an example of a fixing device for a helmet, and a left drawing illustrates an exterior and a right drawing illustrates an internal structure.

FIG. 5 illustrates a fixing device 50 for a helmet. The fixing device 50 is mainly for the helmet 100 for sports. As illustrated in the cross-section in FIG. 5, ear covers 101 and 101 for protecting ears are generally provided on opposite sides of the helmet 100. In the ear cover 101 and 101, a through hole 101*a* is formed on a portion corresponding to the user's ear so as not to interfere with hearing.

The shape of the ear cover 101 including the through hole 101*a* is almost constant. Therefore, it is appropriate to support the helmet 100 using the through hole 101*a* (the through hole 101*a* is used according to the embodiment). When through holes are provided on opposite sides of the helmet 100, it may be used to support the helmet 100 even if the through holes 101*a* are not present.

Particularly, the fixing device 50 includes a first coupling member 60 and a second coupling member 70. The first coupling member 60 is provided to be mountable on the inner circumferential surface of the drum, and the second coupling member 70 is provided to be connected to the first coupling member 60 with each other.

The first coupling member 60 includes a body 61 formed in a disc shape having a greater diameter than the through hole 101*a*, and including an insertion hole 62 provided at a center of a surface of the body 61, a first pressing portion 63 formed in a ring shape formed of an elastic member and installed around the insertion hole 62 on the surface of the body 61, and a mounting plate 64 elastically deformable and protruding from an outer edge portion of the body 61. The mounting plate 64 may correspond to an elastic plate 64.

The first pressing portion 63 and the mounting plate 64 are formed of an elastic member such as rubber or silicone. A plurality of magnets 65 is provided at an outer circumferential side edge of the mounting plate 64 at intervals along the circumferential direction of the edge.

The second coupling member 70 includes a fitting portion 71 formed in a disc shape having a greater diameter than the through hole 101*a*, and including a shaft portion 72 provided at a center of the fitting portion 71, a second pressing portion 73 formed in a ring shape formed of an elastic member and installed around the shaft portion 72 of the fitting portion 71, and a handle portion 74 connected to a portion opposite to the shaft portion 72 of the fitting portion 71. The shaft portion 72 is provided to be fitted from a tip thereof to a predetermined position in the insertion hole 62, and provided to be detachable from the insertion hole 62.

Accordingly, after inserting the shaft portion 72 of the second coupling member 70 from the inside of one side of the ear cover 101 into the through hole 101*a*, the shaft portion 72 protruding from the through hole 101*a* is inserted into the insertion hole 62 of the first coupling member 60. Accordingly, the first coupling member 60 and the second coupling member 70 are connected to each other so as to allow the ear cover 101 to be elastically supported on opposite sides by the first pressing portion 63 of the first coupling member 60 and the second pressing portion 73 of the second coupling portion 70. Accordingly, it is possible to install the fixing device 50 to the helmet 100.

In response to mounting the fixing device 50 to the inner circumferential surface of the drum 3 from the side of the first coupling member 60, the mounting plate 64 is deformed by the magnetic force of the magnet 65 and pressed against the inner circumferential surface of the drum 3. Therefore, even on the inner circumferential surface of the drum 3 having a curved surface, the helmet 100 may be removably fixed to the inner lower side of the drum 3 simply.

<Special Washing Operation>

As described above, in the washing machine 1, the special washing processor 6*b* is provided in the processor 6, and thus the washing machine 1 is configured to perform the special washing operation for a specific object, which is to be washed, through a special washing method using the fixing device 50.

(Rotation Regulation of Drum 3)

In the special washing operation, the washing process and/or the rinsing process are performed, and the spin-drying process is not performed. In addition, in the washing process, only the pulsator 4 is rotationally driven (agitating operation) in order to agitate the water inside the drum 3, and the drum 3 is not rotationally driven. The rotation of the drum 3 is regulated at a predetermined position to maintain the pulsator 4 in a submerged state.

(Mechanical Regulating Means)

The washing machine 1 is configured to perform the rotation regulation of the drum 3 by using a mechanical regulating means. Particularly, a drum stopper configured to mechanically couple the drum 3 to the tub 2 is arranged between the tub 2 and the drum 3. For example, the washing machine 1 may include a drum stopper hooked and coupled to between the tub 2 and the drum 3. Therefore, the rotation of the drum 3 is regulated by driving the drum stopper.

Figure 6:
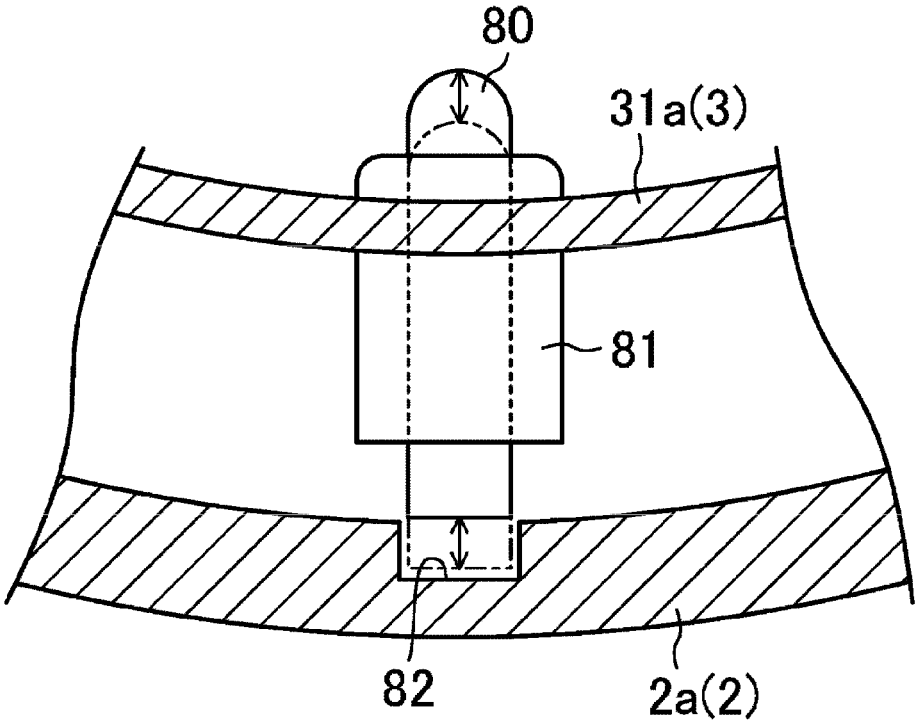
FIG. 6 is a schematic view illustrating an example of a mechanical regulating means configured to regulate a rotation of a drum.

FIG. 6 illustrates a coupling pin 80 as an example of the drum stopper. The coupling pin 80 is provided between a flange portion 31*a* extending along the outer circumference of the opening 31 of the drum 3, and an opposite flange portion 2*a* of the tub 2 opposite to the flange portion 31*a*. The coupling pin 80 is supported to protrude toward the corresponding flange portion 31*a* by a support member 81 provided on the flange portion 31*a*.

A concave portion 82 is formed at a predetermined position of the opposite flange portion 2*a*. By pressing the coupling pin 80 in a state in which the coupling pin 80 and the concave portion 82 are aligned, the coupling pin 80 protrudes from the support member 81, and a tip thereof is inserted into the concave portion 82. Accordingly, the rotation of the drum 3 is regulated at a predetermined position.

The concave portion 82 is not essential. By pressing the coupling pin 80, the tip of the coupling pin 80 may be pressed against the opposite flange portion 2*a*. A coupling hole, into which the coupling pin 80 is inserted, is formed in the flange portion 31*a*, and in the state in which the coupling hole and the concave portion 82 are aligned, the tip of the coupling pin 80 inserted into the coupling hole may be inserted into the concave portion 82. That is, the drum stopper only needs to hold the drum 3 at a predetermined position during the agitating operation.

The operation of inserting or removing the coupling pin 80 may be performed manually or may be performed automatically through electrical control by the processor 6. In the washing machine 1, the case in which the operation of inserting or removing the coupling pin 80 is performed manually is describe as an example.

(Electrical Regulating Means)

In a state in which each rotor of the motor 5 is controlled by an individual inverter or a state in which the drum 3 is driven by a dedicated motor (drum motor) independently of the driving of the pulsator 4, the rotation regulation of the drum 3 may be performed by an electrical means.

For example, in the former case, a three-phase current is supplied to prevent the generation of the rotational force by controlling an inverter configured to supply a current to the inner rotor configured to rotate the drum 3. Accordingly, the inner rotor is not rotated. Therefore, the rotation of the drum 3 may be regulated.

Alternatively, it is also possible to use short break control. That is, the so-called short-brake control, which stops the rotation of the motor by controlling a switching circuit of the inverter to cut off electricity to the motor, is generally used for shortening a spin-drying time (short-brake control is well-known technology and thus a description thereof will be omitted).

Particularly, in the performance of the special washing operation, the short-brake control is performed on the inverter configured to supply the current to the inner rotor. Accordingly, energization of the inner rotor is cut off, and the inner rotor is electrically disconnected. Therefore, the inner rotor is not rotated, and the rotation is suppressed by the action of the permanent magnet provided in the inner rotor. Therefore, the rotation of the drum 3 may be regulated.

In the latter case, in response to stopping the driving of the drum motor, the rotation of the drum 3 may be stopped. The rotation of the drum 3 may be regulated by the short-brake control of the inverter of the drum motor.

(Special Washing Method Using the Fixing Device)

Hereinafter a special washing method using the fixing device will be described. The washing method mainly includes three steps, and the three steps are performed in the washing process or the rinsing process of the special washing operation.

That is, the washing method includes a first step of removably fixing the object to be washed to the inner lower side of the drum 3 through the fixing device, a second step of supplying water in an amount in which at least a part of the pulsator 4 is submerged in the tub 2, and a third step of agitating the water stored in the drum 3 by rotating the pulsator 4 in a state in which the rotation of the drum 3 is regulated to allow the object, which is to be washed, to be placed on the lower side.

Figure 7:
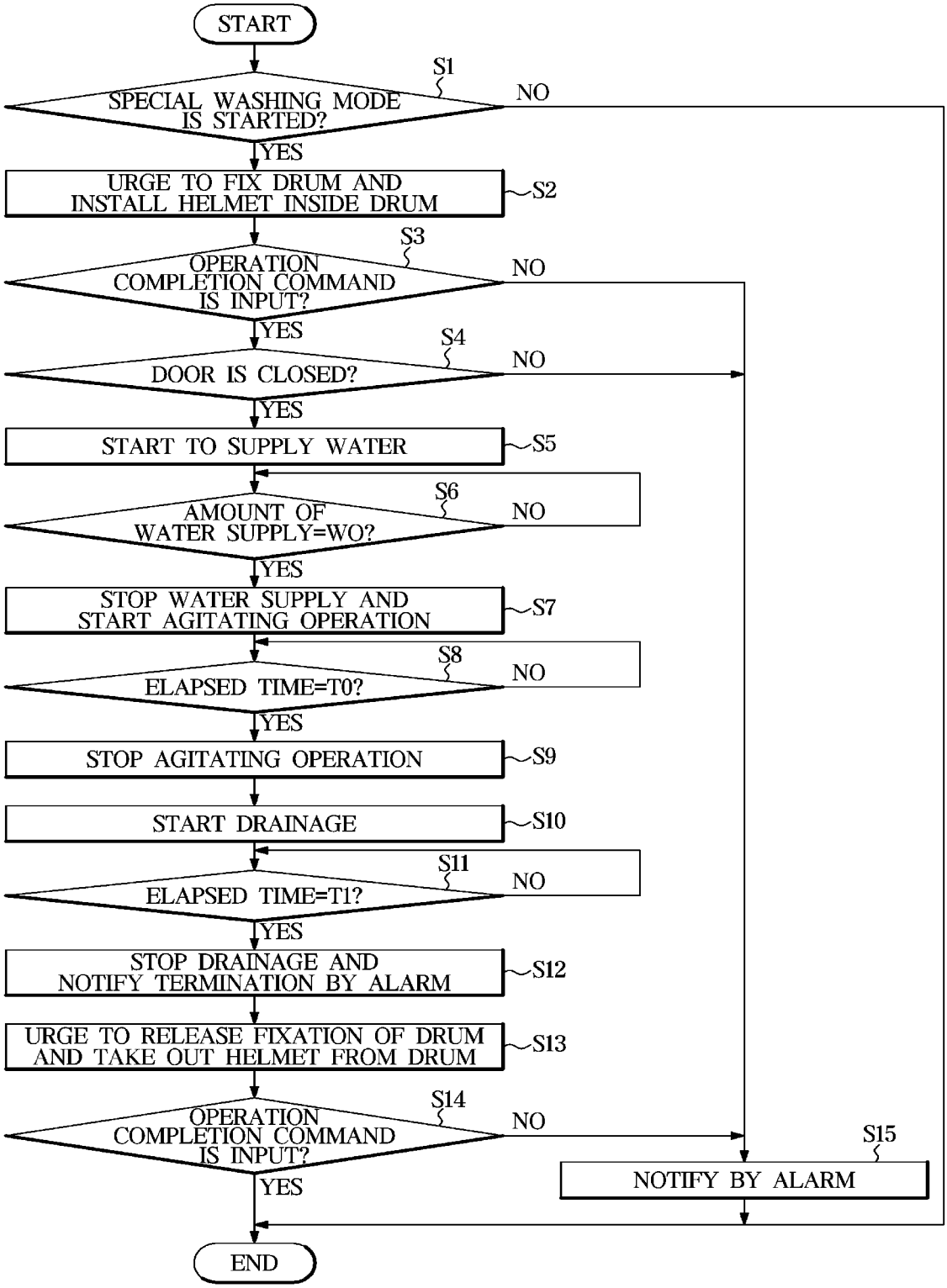
FIG. 7 is a flowchart illustrating a series of flows of a special washing operation.
Figure 8:
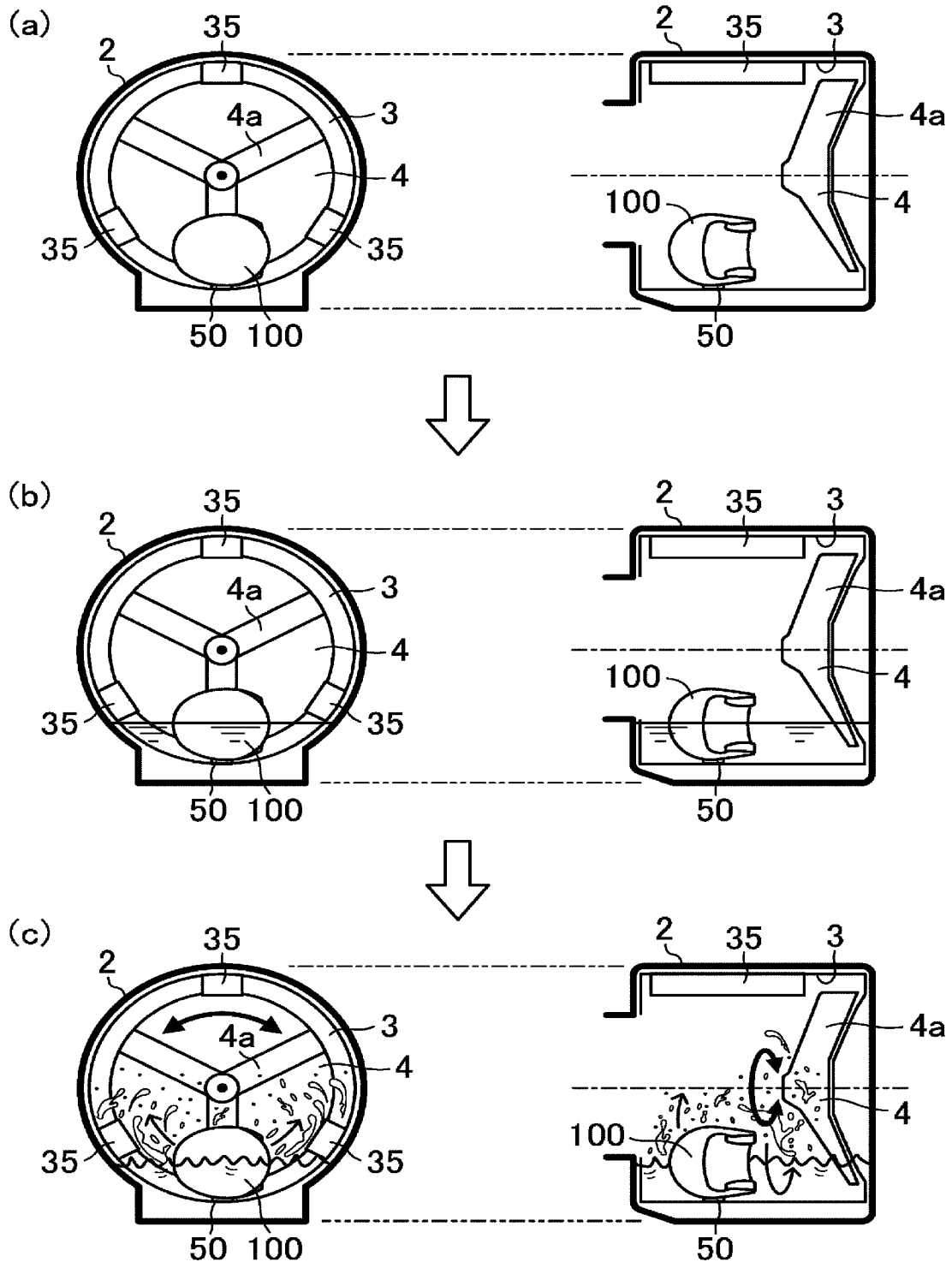
FIG. 8 is a schematic diagram illustrating a main state in the special washing operation.

The first step is mainly performed by a user. The second and third steps are performed by the washing machine 1 (processor 6). FIG. 7 illustrates a series of process flow including the steps. FIG. 8 illustrates a main state of the washing machine in the process of the operation. In the following description, the helmet 100 for sports such as American football is described as the object to be washed.

A user who wants to wash the helmet 100 manipulates the control panel 13 to select a driving mode (special washing mode) for performing the special washing operation, and starts driving the washing machine 1. Accordingly, in the washing machine 1, a signal for instructing of a special washing mode operation is received through the control panel 13 to the processor 6. At this time, in the case of washing with water, the user proceeds with the process as it is, but in the case of using detergent, etc., the user inputs the detergent to the detergent tray in advance.

The processor 6 determines whether or not the operation of the special washing mode is started based on the signal received through the control panel 13 (1). Therefore, in response to determining that the operation of the special washing mode is started, the special washing operation is started by the special washing processor 6*b* of the processor 6.

In response to the start of the special washing operation, the processor 6 urges the user to perform the regulation of the rotation of the drum 3, that is, inserting the coupling pin 80, through a monitor of the control panel 13. At the same time, through the monitor of the control panel 13, the processor 6 urges the user to perform the first step, that is, to install the helmet 100 to the inner lower side of the drum 3 (2).

Accordingly, the user rotates the drum 3 to align the coupling pin 80 and the concave portion 82, and then pushes the coupling pin 80 into the concave portion 82. Accordingly, the drum 3 is fixed in a predetermined position.

The user also installs the fixing device 50 to the contaminated helmet 100. Particularly, the fixing device 50 is installed to one side of the ear cover 101 of the helmet 100.

As illustrated in FIG. 8A, the helmet 100 is accommodated in the drum 3 through the inlet 12, and the fixing device 50 is installed at the lower inside of the drum 3. At this time, because the mounting plate 64 is deformed and pressed against the inner circumferential surface of the drum 3 by the magnetic force of the magnet 65, the user can simply operate the fixing device 50 even if the helmet 100 is placed. As a result, the helmet 100 may be fixed to the inner lower side of the drum 3 through the fixing device 50.

In addition, at this time, it is required to arrange the helmet 100 so as not to contact the pulsator 4. Because the shape and size of the helmet 100 vary, it is difficult to properly arrange the helmet 100 in the conventional manner. However, because the fixing device 50 is attached to the drum 3 by only the action of magnetic force, the position may be easily adjusted only by changing the position of the helmet 100 against the suction force.

After the helmet 100 is fixed to the inner lower side of the drum 3, the user closes the door 11. The user inputs an operation completion command to the processor 6 by manipulating a button or the like displayed on the monitor of the control panel 13.

In response to the operation completion command not being input for a predetermined period of time (no in 3) or in response to the door 11 not being closed for a predetermined period of time (no in 4), the processor 6 notifies the user of an abnormality by an alarm or the like (15). The processor 6 terminates the special washing mode without performing the special washing operation.

On the other hand, in response to the operation completion command being input and in response to determining that the door 11 is closed, the processor 6 starts the special washing operation. That is, the special washing processor 6*b* drives the water supply device 21 to start a water storage operation (water storage process) (5). An amount of water supply is pre-set in the processor 6. In the special washing operation, washing is performed using agitating and sprinkling action, not by the beating washing. For this purpose, an amount of water supply for the special washing operation is greater than that of the general washing operation for clothes.

Therefore, it is required to supply water in an amount, in which at least a part of the pulsator 4 is submerged, to the drum 3. It is possible to supply the maximum amount of water that can be stored in the tub 2, but it is appropriate to supply an amount of water that submerges a lower portion of the helmet 100, that is supplying water until a water surface is under the center of the pulsator 4, as shown in FIG. 8B. The water surface of the tub 2 and/or the drum 3 may be the water level of the tub 2 and/or the drum 3.

It is possible to effectively agitate the stored water as well as raising water high upward by the rotation of the pulsator 4, and thus it is possible to spray water from the upper side of the helmet 100. Further, it is possible to save water.

The processor 6 determines whether or not the amount of water supply reaches a set water amount Wo (6), and in response to determining that the amount of water supply reaches the set water amount (yes in 6), the processor 6 stops the water supply and starts the agitating operation (agitating process) by driving the motor 5 (7).

The rotation of the drum 3 is regulated by the connection of the coupling pin 80 and the concave portion 82. As a result, the helmet 100 is always positioned in the lower side in the drum 3 and thus the submerged state is maintained. In this state, the pulsator 4 is rotated and the agitating operation is performed.

As the pulsator 4 is rotated, the water stored in the drum 3 is agitated. Due to the small amount of water, the torque is small and thus the pulsator 4 is rotated rapidly in a stopped state. Therefore, water may be agitated effectively. A lower portion of the helmet 100 that is submerged may be washed by the flow of water. At the same time, the water stored in the drum 3 is raised high by the rotation of the pulsator 4, and the water is scattered upward of the helmet 100. The upper part of the helmet 100 is also washed by the scattered water.

At this time, the rotation of the pulsator 4 may be in a constant direction, but it is appropriate to reverse the rotation direction, as shown in FIG. 8C. Particularly, it is more appropriate to alternately rotate the pulsator 4 in the forward rotation direction and the reverse rotation direction for the same period of time. Particularly, the processor 6 controls the driving of the motor 5 to allow the pulsator 4 to be alternately rotated in both the forward rotation direction and the reverse rotation direction in a short time.

By reversing the rotation direction of the pulsator 4, it is possible to improve the agitating action and the sprinkling action. Because the deflection of the flow of water and the sprinkling water are suppressed, the helmet 100 may be washed in a balanced manner.

In response to determining that a period of time reaches a preset operation time T0 (yes in 8), the processor 6 stops the agitating operation (9).

The processor 6 performs a drainage operation. That is, the processor 6 drives the drainage device 22 to start an operation of draining water from the tub 2 (10). In response to determining that a predetermined time T1 for completing the drainage elapses (yes in 11), the processor 6 stops draining and notifies a user that the operation is completed by an alarm or the like (12).

In addition, through the monitor of the control panel 13, the processor 6 urges the user to release the rotation regulation of the drum 3, that is to take out the coupling pin 80. At the same time, through the monitor of the control panel 13, the processor 6 urges the user to take out the helmet 100 from the inside of the drum 3 (13).

Accordingly, the user pulls out the coupling pin 80 from the concave portion 82. Therefore, the rotation regulation is released, and the drum 3 becomes rotatable. The user also takes out the helmet 100 together with the fixing device 50 from the drum 3. At this time, because the fixing device 50 is attached to the drum 3 by only the action of magnetic force, the fixing device 50 may be easily taken out together with the helmet 100.

Finally, in response to the operation completion command being input to the processor 6 by manipulating a button displayed on the motor of the control panel 13 by the user, the series of special washing operation is terminated (yes in 14). The user may take out the helmet 100 and remove the fixing device 50 from the helmet 100 and dry the helmet 100 by wiping off the remaining water or drying the helmet 100 in the shade.

On the other hand, in response to the operation completion command not being input for the predetermined period of time (no in 14), the processor 6 notifies the user of an abnormality through an alarm or the like (15).

The user may change the direction of the helmet 100 and perform the special washing operation a plurality of times. In addition, in the case of washing by adding detergent, it is appropriate to perform the special washing operation with only water in order to additionally perform rinsing by washing with water. A detergent washing mode may be provided in the washing machine 1 and thus the special washing processor 6*b* continuously performs the washing process and the rinsing process.

Application Example

In the above-described washing method, the helmet 100 is washed by using the agitating operation by the rotation of the pulsator 4, but a water circulation mechanism may be further used.

That is, the washing machine 1 is provided with a water circulation mechanism configured to circulate the water stored in the tub 2 by spraying the water into the drum 3. The special washing processor 6*b* drives the water circulation mechanism while performing the agitating operation during the special washing operation.

Because the water is sprayed from the spray nozzle 8 toward the inside of the drum 3, the upper part of the helmet 100 may be further washed. Because the fluidity of the water stored in the tub 2 and the drum 3 is also increased, the lower part of the helmet 100 may be further washed. The water circulation mechanism may be continuously or intermittently driven during the performance of the special washing operation.

Figure 9:
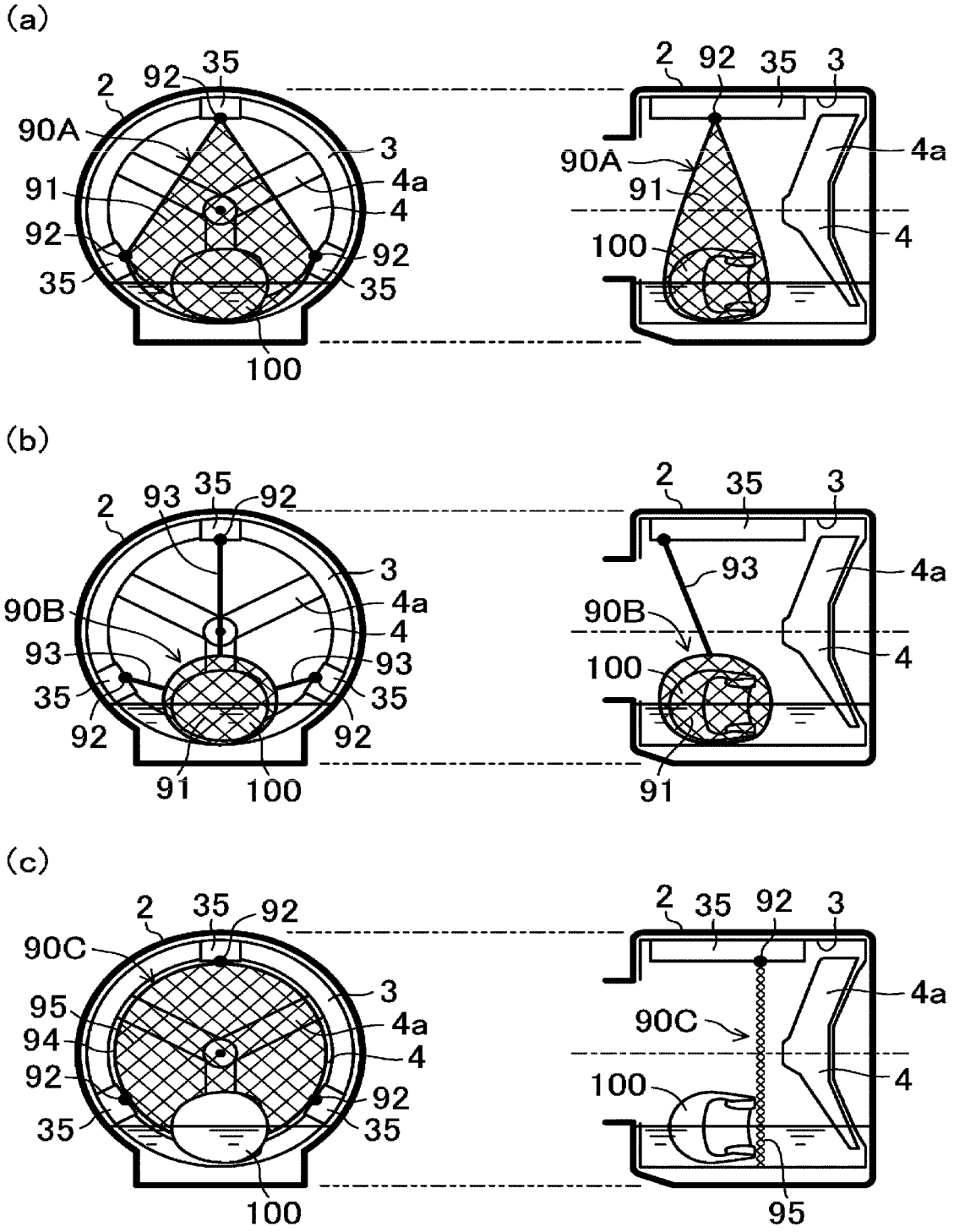
FIG. 9 is a view illustrating another example of the fixing device.
Figure 10:
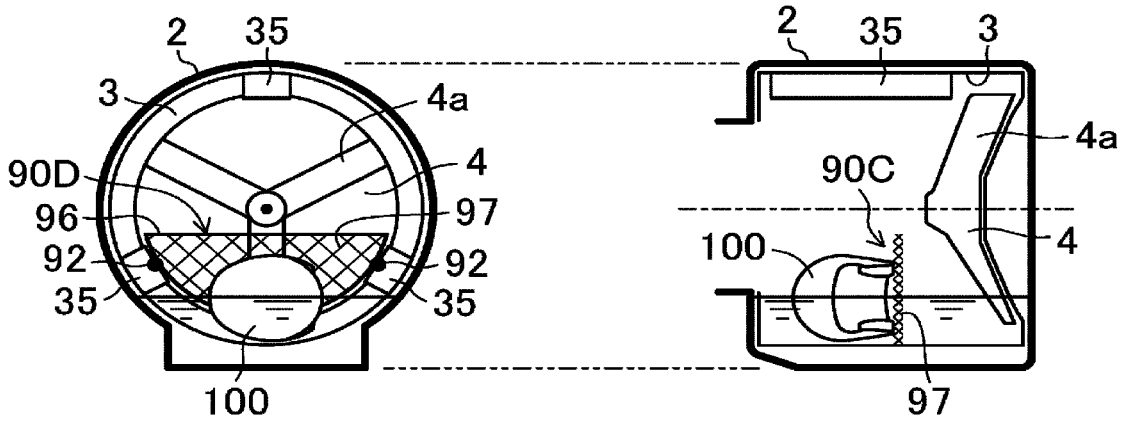
FIG. 10 is a view illustrating another example of the fixing device.
Figure 10:
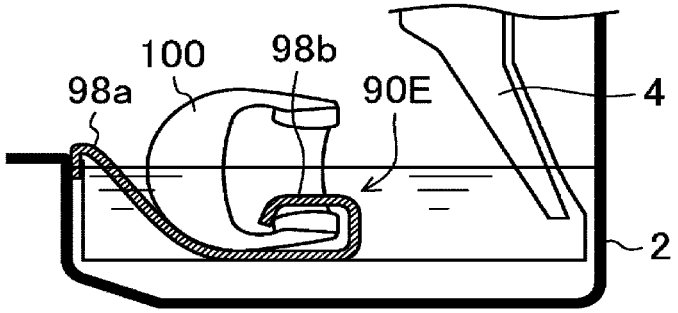
Figure 10:
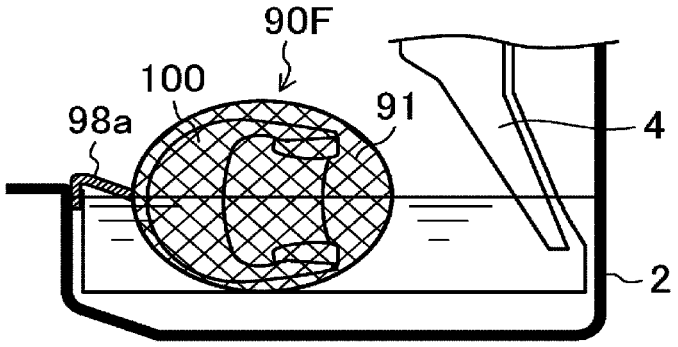

The drum washing machine according to the disclosed technology is not limited to the above-described embodiment, and may include various other configurations. For example, the shape of the fixing device may be appropriately changed according to the object to be washed. The shape of the fixing device that is employable is exemplified in FIGS. 9 and 10.

A fixing device 90A illustrated in FIG. 9A includes a mesh net 91 formed in a bag shape and a hook 92 for fixing. The mesh net 91 may include an opening configured to be opened or closed and thus the helmet 100 may be inserted or withdrawn through the opening. The hooks 92 are installed at a plurality of places spaced apart from each other in the mesh net 91.

The hook 92 may be fixed by being hooked on a drain hole (not shown) formed in the lifter 35. The fixing device 90A is used in such a way that the mesh net 91, in which the helmet 100 is placed and the opening thereof is closed, is accommodated in the drum 3 and then the hook 92 is hooked and fixed to the lifter 35.

A fixing device 90B illustrated in FIG. 9B is an application example of the fixing device 90A illustrated in FIG. 9A. In addition to the mesh net 91 and the hook 92, a line 93 provided to connect the hook 92 to the mesh net 91 is provided. It is possible to reduce the size of the mesh net 91 by a length of the line 93.

A fixing device 90C illustrated in FIG. 9C includes a circular frame 94 having a diameter smaller than the inner diameter of the drum 3, a mesh net 95 provided on the circular frame 94, and a plurality of hooks 92 provided around the circular frame 94 in correspondence with each lifter 35.

The fixing device 90C is installed and used so as to divide the inside of the drum 3 into a front space and a rear space. The helmet 100 and the like are accommodated in the front space of the drum 3 partitioned by the fixing device 90C.

A fixing device 90D illustrated in FIG. 10D is an application example of the fixing device 90C illustrated in FIG. 9C. The fixing device 90D includes an arcuate frame 96, a mesh net 97 provided on the arcuate frame 96, and two hooks 92 and 92 provided on opposite sides of the arcuate frame 96 in correspondence with each lifter 35.

A fixing device 90E illustrated in FIG. 10E is a fixing device 90 for exclusive use of the helmet. The fixing device 90E is formed of metal or resin having flexibility, and includes a first hook portion 98*a* hooked on the opening of the drum 3 and a second hook portion 98*b* hooked on the helmet 100. For washing the helmet 100, the helmet 100 is fixed to the drum 3 through the fixing device 90E.

A fixing device 90F illustrated in FIG. 10F is an application example of the fixing device 90B and the fixing device 90E. The fixing device 90F includes a mesh net 91 and a first hooking portion 98*a*.

While the present disclosure has been particularly described with reference to exemplary embodiments, it should be understood by those of skilled in the art that various changes in form and details may be made without departing from the spirit and scope of the present disclosure.

What is claimed is:

1. A drum washing machine comprising:

a housing having an inlet on a front surface;

a tub inside the housing;

a drum having an opening corresponding to the inlet and configured to be rotatable inside the tub;

a pulsator inside the drum, coupled to one side of the drum along a front and rear direction of the drum, and configured to be rotatable independent of the drum;

a drum stopper configured to couple the drum to the tub so that the drum is locked;

a holder configured to detachably hold an object to the drum; and a processor configured to control:

an amount of water introduced into the tub for washing the object until a water level in the tub is located below a center of the pulsator, a rotation of the drum, a rotation of the pulsator, and the pulsator to agitate the water inside the tub while the drum is locked by the drum stopper based on the holder holding the object to maintain a position of the object in the tub.

2. The drum washing machine of claim 1, wherein
the drum stopper includes a pin that is insertable into a concave portion of the tub.

3. The drum washing machine of claim 1, further comprising:
a motor configured to rotate the drum, wherein the rotation of the drum is stopped by electrically controlling the motor.

4. The drum washing machine of claim 1, wherein
the processor is configured to control the pulsator to rotate.

5. The drum washing machine of claim 1, further comprising:
a water circulation mechanism configured to circulate the water stored in the tub by spraying the water into the drum, and configured to be driven by the processor.

6. The drum washing machine of claim 1, wherein
the holder is mountable on an inner circumferential surface of the drum, the holder provided to support the object to be washed to allow the object to be washed to be fixed to the lower inside of the drum.

7. The drum washing machine of claim 6, wherein
the object to be washed is a helmet and the holder is configured to support the helmet.

8. The drum washing machine of claim 7, wherein
the holder is configured to support the helmet having a through hole formed on opposite sides of the helmet.

9. The drum washing machine of claim 8, wherein
the holder includes:
a first coupling member mountable to the inner circumferential surface of the drum;
a second coupling member connected to the first coupling member; and
a shaft portion provided to connect the first coupling member to the second coupling member and inserted into the through-hole so as to allow the helmet to be supported by the holder.

10. The drum washing machine of claim 9, wherein
the first coupling member includes:
a body connected to the second coupling member;
a mounting plate mounted on an outer circumference of the body and provided to be elastically deformable; and
a magnet provided along an edge of the mounting plate to allow the mounting plate to be pressed against the inner circumferential surface of the drum so as to allow the holder to be fixed to the inner circumferential surface of the drum.

11. The drum washing machine of claim 1, further comprising:
a water supply device configured to supply water to the tub; and
a drainage device configured to discharge the water from the tub,
wherein the processor is configured to control operations of the water supply device and the drainage device.

12. The drum washing machine of claim 11, wherein
the holder is coupled to a lower side of the drum to allow the object to be washed to be coupled to the lower inside of the drum.

13. The drum washing machine of claim 11, further comprising:
the drum stopper includes a pin that is insertable into a concave portion of the tub.

14. The drum washing machine of claim 11, wherein
the pulsator is coupled to one side of the drum along a front and rear direction of the drum,
wherein the processor controls a water supply to the tub until a water level in the tub is located below a center of the pulsator.

15. A drum washing machine comprising:
a housing having an inlet on a front surface;
a tub inside the housing;
a drum having an opening corresponding to the inlet and configured to be rotatable inside the tub;
a pulsator inside the drum, coupled to one side of the drum along a front and rear direction of the drum, and configured to be rotatable independent of the drum;
a drum stopper configured to couple the drum to the tub, so that the drum is locked; and
a processor configured to control:
an amount of water introduced into the tub for washing an object until a water level in the tub is located below a center of the pulsator,
a rotation of the drum,
a rotation of the pulsator, and
the pulsator to agitate the water inside the tub while the drum is locked by the drum stopper.

* * * * *